US006837390B2

(12) United States Patent
Lane et al.

(10) Patent No.: US 6,837,390 B2
(45) Date of Patent: Jan. 4, 2005

(54) HOT-FILLABLE, BLOW MOLDED CONTAINER

(75) Inventors: Michael T. Lane, Brooklyn, MI (US); Mark A. Chapman, Howell, MI (US)

(73) Assignee: Amcor Limited, Abbotsford (AU)

( * ) Notice: Subject to any disclaimer, the term of this patent is extended or adjusted under 35 U.S.C. 154(b) by 76 days.

(21) Appl. No.: 09/862,032

(22) Filed: May 21, 2001

(65) Prior Publication Data

US 2002/0008077 A1 Jan. 24, 2002

Related U.S. Application Data

(60) Provisional application No. 60/206,516, filed on May 22, 2000.

(51) Int. Cl.[7] ..... B65D 90/02
(52) U.S. Cl. ..... 215/381; 220/660
(58) Field of Search ..... 215/381, 382, 215/383, 385, 379, 384; 220/660, 666, 669, 674

(56) References Cited

U.S. PATENT DOCUMENTS

| | | | | | |
|---|---|---|---|---|---|
| 3,335,902 | A | | 8/1967 | Javorik | |
| D263,026 | S | * | 2/1982 | Beechuk et al. | D9/404 |
| D289,979 | S | * | 5/1987 | Crawford | D9/404 |
| 4,946,053 | A | * | 8/1990 | Conrad | 215/381 |
| 5,178,289 | A | | 1/1993 | Krishnakumar et al. | |
| D337,525 | S | * | 7/1993 | Collette et al. | D9/542 |
| 5,226,538 | A | * | 7/1993 | Roselle | 206/457 |
| 5,303,834 | A | | 4/1994 | Krishnakumar et al. | |
| 5,381,910 | A | | 1/1995 | Sugiura et al. | |
| 5,407,086 | A | | 4/1995 | Ota et al. | |
| D382,479 | S | * | 8/1997 | D'Amico et al. | D9/434 |
| 5,690,244 | A | | 11/1997 | Darr | |
| 5,833,115 | A | | 11/1998 | Eiten | |
| 6,095,705 | A | * | 8/2000 | Phillips | 415/115 |
| D446,730 | S | * | 8/2001 | Adee et al. | D9/563 |
| D449,539 | S | * | 10/2001 | Lakatosh et al. | D9/530 |
| D462,273 | S | * | 9/2002 | Crawford | D9/542 |
| D462,275 | S | * | 9/2002 | Potts et al. | D9/558 |

FOREIGN PATENT DOCUMENTS

| | | |
|---|---|---|
| WO | WO 00/68095 | 11/2000 |

* cited by examiner

*Primary Examiner*—Lien Ngo
(74) *Attorney, Agent, or Firm*—Harness, Dickey & Pierce, P.L.C.

(57) ABSTRACT

A plastic container having a sidewall extending between a shoulder portion and a bottom portion. The sidewall has a substantially oval shape in cross-section and includes a pair of opposing columns and a pair of opposing panels. The columns are located at opposing ends of the oval shape and the panels are located at opposing sides of the oval shape. This configuration allows for reduced as-packaged vacuum pressures when the container is used in hot-fill applications.

28 Claims, 4 Drawing Sheets

| Finish Weights |
|---|
| 33mm finish = 4.5 gm |
| 38mm finish = 9.5 gm |
| 43mm finish = 10.0 gm |

Container Weight w/finish

| Assignee Stock Round w/panels ■ | Competitor's Stock Round w/panels ● | Present container ◆ |
|---|---|---|
| 31.5 gm | 29.0 gm | 22.5 gm |
| 36.5 gm | 34.0 gm | 27.5 gm |
| 37.0 gm | 34.5 gm | 28.0 gm |

HOT-FILLABLE, BLOW MOLDED CONTAINER

REFERENCE TO PRIOR PROVISIONAL APPLICATION

This application claims the benefit of prior provisional application No. 60/206,516 filed May 22, 2000.

BACKGROUND OF THE INVENTION

1. Field of the Invention

The present invention generally relates to a hot-fillable, blow molded plastic container. More particularly, the invention relates to containers of the above variety having a novel construction and also having panel sections resisting undesirable deformation in accommodating reductions in product volume during cooling of a hot-filled product.

2. Description of the Prior Art

Hot-fillable plastic containers have become commonplace for the package of products (e.g., juices) which must be filled into the container while hot to provide for adequate sterilization. During filling, the product is typically dispensed into the container while at a temperature of 180° F. and above. Such a container is known as a "hot-fill" container. After filling, the container is sealed or capped and, as the product cools, a negative internal pressure forms within the sealed container. If not properly designed, the negative internal pressure will cause the container to deform in unacceptable ways, both from an aesthetic and a performance perspective.

Biaxially-oriented polyethylene terephthalate (PET) containers have long been used to receive the hot-filled product with a resulting minimal amount of distortion in the container after cooling. To accommodate the shrinkage and negative internal pressure, the most often employed method is the incorporation of a plurality of recessed vacuum panels into the body portion of the container. The vacuum panels are designed so that as the product cools, they will deform and move inwardly. In one style of container having vacuum panels, the vacuum panels are equidistantly spaced around the body of the container and separated by land portions. A wrap around label is then used to cover all of the vacuum panels and provide the container with an aesthetically pleasing look.

A major problem with containers of the above mentioned vacuum panel design is that they are not easily handled by the end consumer, particularly in 48 oz., 64 oz. and larger varieties.

Plastic containers having specifically designed gripping areas, hereinafter referred to as pinch-grips, were originally seen in containers for "cold-fill" applications. Not being specifically designed for receiving a hot-fill product, those containers, which did not include vacuum panels, could not accommodate the hot-filling procedure or the decrease in internal pressure which occurs in a hot-fill application.

U.S. Pat. Nos. 5,141,120 and 5,141,121, both to Brown et al., are believed to be the first patents which disclose vacuum panels and pinch-grips in combination in a hot-fill container. More particularly, these patents illustrate and describe the incorporation of the vacuum panels and the pinch-grips together into a common vacuum/pinch-grip panel of the container.

Since the issuance of the Brown et al. patents, other containers have also adopted the vacuum/pinch-grip panel construction. Examples of such patents include U.S. Design Pat. No. 334,457 and U.S. Pat. Nos. 5,392,937; 5,472,105 and 5,598,941.

By combining the pinch-grips and vacuum panels into a common panel as done in the above referenced patents, front and rear label areas can be provided in such a manner that eliminates the need for vacuum panels beneath the label. Instead, horizontal stiffening ribs are provided in these label panel areas for reinforcement and distortion resistance.

When properly designed, vacuum panels of all varieties move inwardly as the container's internal pressure decreases and the product cools. As with all PET or other plastic containers, it is desirable to minimize the weight of the container in order to reduce the material cost in forming the container as well as the shipping costs associated with the container. Because of the vacuum applied to these containers and the need to control distortion of the container under vacuum, weight reduction is increasingly hard to achieve.

Another variety of container is the squeezable container used to dispense a product such as margarine, catsup, lotion, creams or even liquid beverages. A problem associated with containers of this variety is the inconsistent delivery of the amount of product. The amount of product delivered is controlled by the user of the container depending on how much they squeeze the container. While in theory there is a maximum amount of product which can be delivered from a container with one squeeze, these containers are not designed to deliver a preset amount of product per squeeze.

In view of the above and other limitations, one object of the present invention is to provide a lightweight plastic container which resists deformation and distortion during filling, cooling and subsequent handling of the container, which can be easily handled by an end consumer.

Another object of the present invention is to provide a plastic container having a vacuum panel structure which resists undesired deformation and distortion during filling and subsequent cooling, and which absorbs a majority of the vacuum pressure applied to the container.

A further object of this invention is to provide a squeezable container.

Still another object of this invention is to provide a squeezable container wherein a controlled amount of product is dispensed per squeeze.

SUMMARY OF THE INVENTION

In achieving the above and other objects, the present invention provides a hot-fillable, blow molded plastic container suitable for receiving a product which is initially filled in a hot state, the container subsequently being sealed so that cooling of the product creates a reduced volume of product and a reduced pressure within the container. Another aspect of the invention is that the container is lightweight, compared to containers of similar size, while still controllably absorbing the vacuum in the container and providing excellent structural integrity and resistance to top loadings from filler valves and the like. These aspects are achieved through implementation of a novel sidewall construction. Finally, the container of the present invention is also a squeezable container which delivers or dispenses a predetermined amount of product per squeeze. When used in this capacity, the container can be used in non-hot or cold fill applications as well as hot-fill applications.

Additional objects, features and advantages of the present invention will become apparent to a person skilled in the art after consideration of the following description, taken in conjunction with the appended claims and figures.

DESCRIPTION

Figure 1:
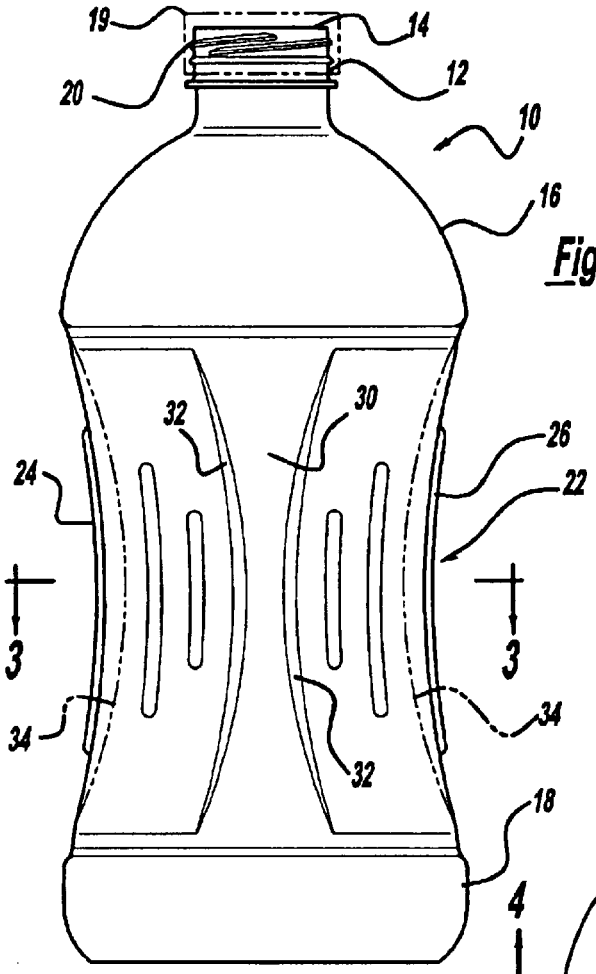
FIG. 1 is a side elevational view of a container embodying the principles of the present invention.

Referring now to the drawings, FIG. 1 illustrates a hot-fillable, blow molded plastic container 10 which embodies the principles of the present invention. The container 10 is designed to be filled with a product, typically a liquid, while the product is in a hot state. After filling, the container 10 is sealed and cooled. During cooling, the volume of the product in the container 10 decreases which in turn results in a decreased pressure within the container 10. While designed for use in hot-fill applications, it is noted that the container 10 is also acceptable for use in non-hot-fill applications.

Since the container 10 is designed for "hot-fill" applications, the container 10 is manufactured out of a plastic material, such as polyethylene terephthalate (PET), and is heat set enabling the container 10 to withstand the e tire hot-fill procedure without undergoing uncontrolled or unconstrained distortions. Such distortions are typically a result of either the temperature and pressure during the initial hot-filling operation or the subsequent partial evacuation of the container's interior as a result of cooling of the product. During the hot-fill process, the product is normally heated to a temperature of about 180° F. or above and dispensed into the already formed container 10 at these elevated temperatures.

Figure 4:
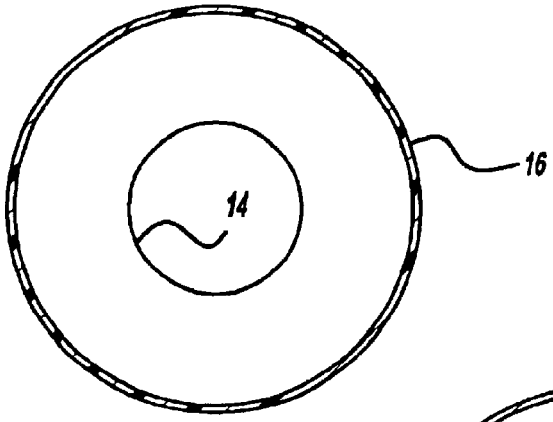
FIG. 4 is a cross-sectional view taken substantially along line 4—4 in FIG. 2 through the shoulder of the container.
Figure 5:
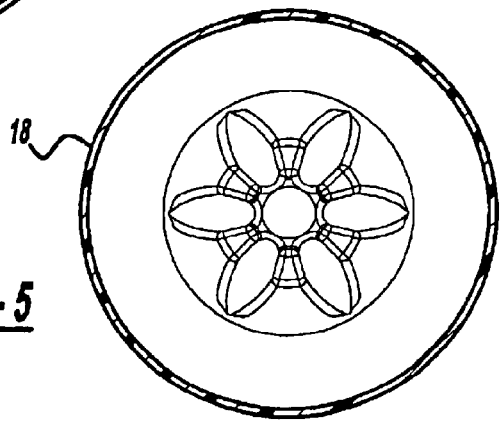
FIG. 5 is a cross-sectional view taken substantially along line 5—5 in FIG. 2 through the bottom of the container.

As illustrated in the figures, the container 10 generally includes a neck 12, which defines a mouth 14, a shoulder portion 16 and a bottom portion 18. As illustrated in FIGS. 4 and 5, the shoulder portion 16 and the bottom portion 18 are substantially annular or circular in cross-section. A cap 19 engages threads 20 on the neck 12 to close the mouth 14 and seal the container 10.

Figure 3A:
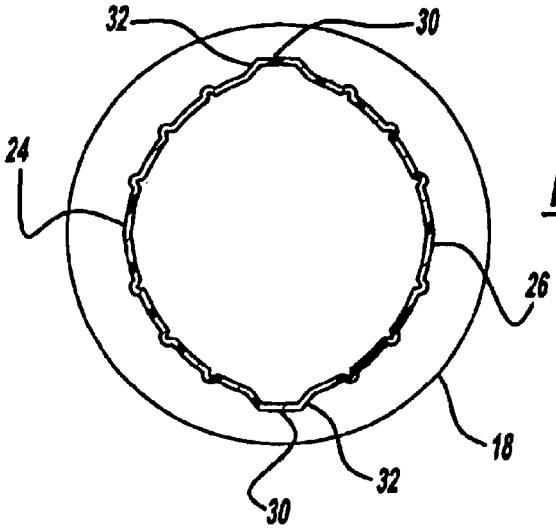
FIG. 3*a* is a cross-sectional view taken substantially along line 3—3 of FIG. 1 of a container embodying the principles of the present invention and generally illustrates the container shape prior to deflection under vacuum forces.
Figure 3B:
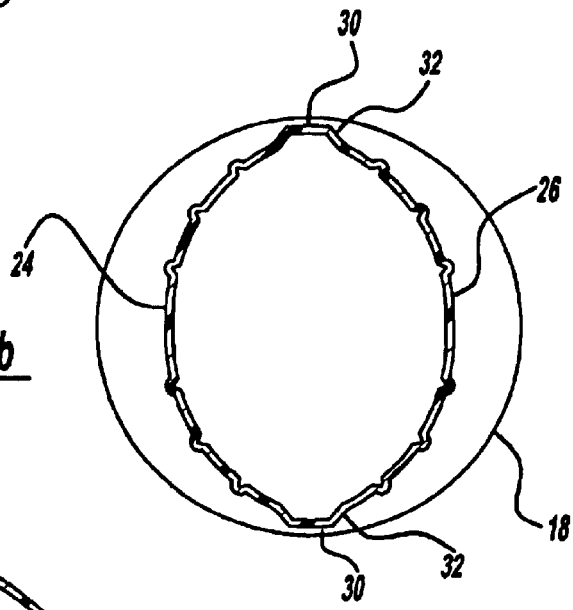
FIG. 3*b* is a cross-sectional view similar to that seen in FIG. 3*a* and generally illustrates the container shape after deflection under vacuum forces.

Extending between the shoulder portion 16 and the bottom portion 18 is a sidewall or body 22 of the container 10. As shown in FIGS. 3*a* and 3*b*, the body 22 has a shape which, when viewed cross-sectionally, is generally elliptical or oval. As illustrated in FIGS. 1, 3*a* and 3*b*, the body 22 includes a front panel 24, which extends vertically between the shoulder portion 16 and the bottom portion 18 of the container 10, and a rear panel 26 that similarly extends vertically between the shoulder portion 16 and the bottom portion 18 of the container 10. The front and rear panels 24 and 26 are located diametrically opposite one another and, if desired, can be mirror images of one another. Thus, the "front" and "rear" designations are merely used for differentiation purposes and not to designate actual front and rear portions of the container 10.

As illustrated in FIG. 1, the front and rear panels 24 and 26 exhibit a generally inward, arcuate shape from top to bottom between the shoulder portion 16 and the bottom portion 18. This arcuate shape could also be described as concave, defining a hourglass silhouette. The two panels 24 and 26 cooperate to define a minimum diameter for the container 10 generally at about their longitudinal midpoint.

As illustrated in FIGS. 3*a* and 3*b*, the front and rear panels 24 and 26 are also arcuately shaped in a transverse direction. Transversely, however, the arcuate shape is shown as being generally outwardly shaped or convex. Thus, the panels 24 and 26 are structured such that a person handling the container 10 can grasp the container 10 between his/her thumb and fingers of one hand.

Figure 2:
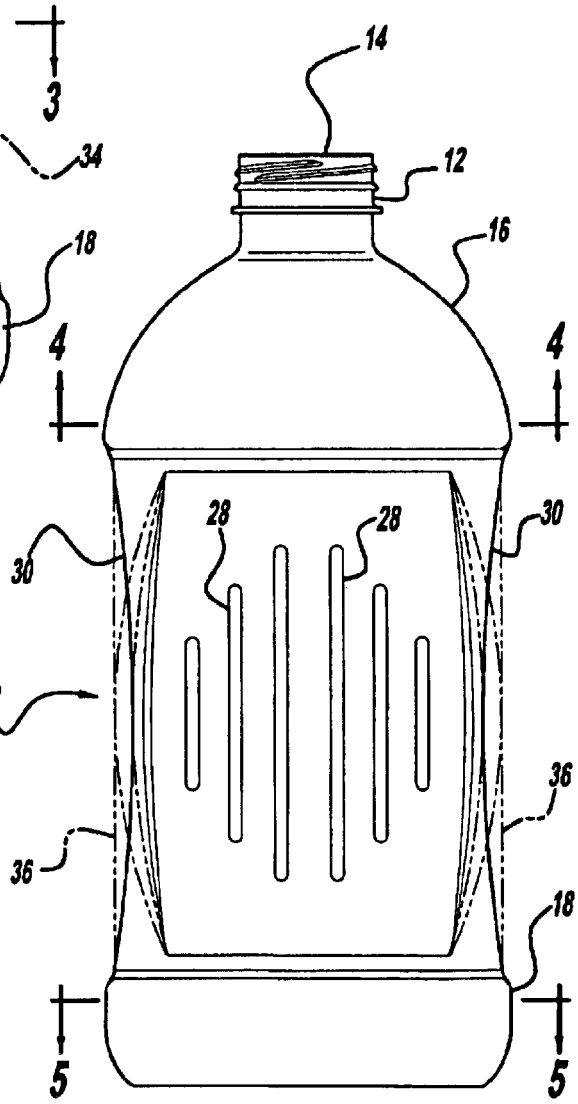
FIG. 2 is a front elevational view of the container shown in FIG. 1.

The panels 24 and 26 are also provided with ribbings 28. The ribbings 28 provide a grip surface on the panels 24, 26 so that the container 10 can be easily handled by an end consumer. The ribbings 28 may be vertically oriented, as shown in FIGS. 1 and 2, horizontally oriented, or as a combination of vertically and horizontally oriented. Instead of ribbings 28, other grip features such as dimples, protrusions or the like, could also be used and are contemplated. In addition, it is anticipated that a decorative embossed motif, such as, a simulation of water beads or the trunk and leaves of a tree, could be superimposed over areas of the shoulder portion 16, the bottom portion 18, and the body 22 to create a continuous integrated appearance.

Separating the front panel 24 from the rear panel 26 is a pair of column portions 30. Located on opposing sides of the container 10, the column portions 30 are shown in FIGS. 3*a* and 3*b* to be located at the ends of the oval cross-sectional shape of the container 10.

As shown in FIGS. 1 through 3*b*, the column portions 30 extend from the shoulder portion 16 to the bottom portion 18. Over their length, the width of the column portions 30 varies. In FIG. 1, the column portions 30 (from the shoulder portion 16 to the bottom portion 18) decrease in width to about their longitudinal midpoint and thereafter increase in width. This width variation is generally symmetrical about the midpoint of the column portions 30 and provides the column portions 30 with a hourglass silhouette. In alternative embodiments, the column portions 30 width need -not vary as described above. Instead they may be asymmetrical about a medial line through the column portions 30 or may increase, decrease or remain constant in width from the shoulder portion 16 to the bottom portion 18.

As illustrated in FIG. 2, the column portions 30 also exhibit a shape which is generally inwardly shaped or concave, at least when the container 10 is initially formed. The radial extent of this concave shape, however, is less than that of the panels 24 and 26 discussed above.

The transition between the column portions 30, and the panels 24 and 26 comprises a transition wall or step 32 which exhibits a contour similar to that of the column portions 30 themselves. This transition wall 32 defines a step downward from the column portions 30 to the panels 24 and 26 since the column portions 30 are located a greater radial distance from the central axis of the container 10.

Figure 6:
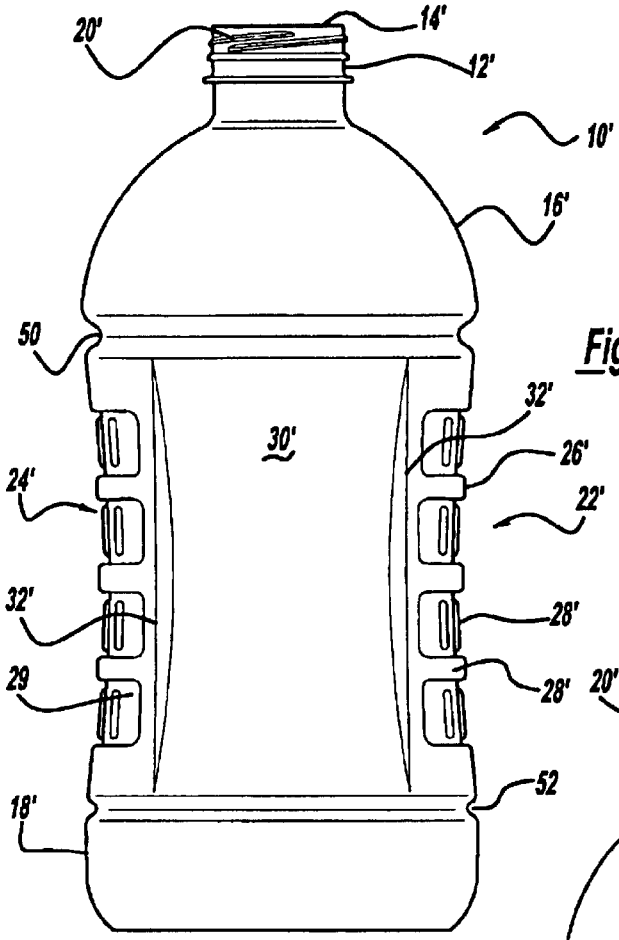
FIG. 6 is a side elevational view of a second embodiment of a container according to the present invention.
Figure 7:
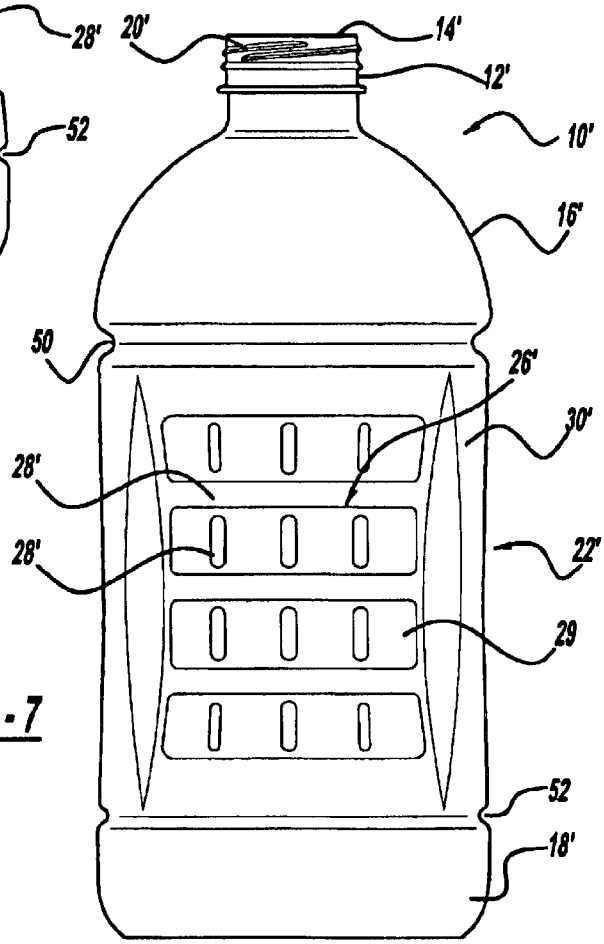
FIG. 7 is a front elevational view of the container shown in FIG. 6.

A second preferred embodiment, which provides certain additional structural and functional advantages over the first described embodiment, is illustrated in FIGS. 6 and 7. Like elements have been given like reference numeral designations including a prime (′). The hot-fillable, blow molded plastic container 10′ includes a neck 12′, which defines a mouth 14′, a shoulder portion 16′ and a bottom portion 18′. A cap (not shown) engages threads 20′ on the neck 12′ to close the mouth 14′ and seal the container 10′.

A recessed rib or groove 50 is provided in the shoulder portion 16′. A recessed rib or groove 52 is provided in the bottom portion 18′. Recessed ribs or grooves 50 and 52 transition into a sidewall or body 22′. Similar to the body 22 of the container 10, the body 22′ of the container 10′ has a shape, when viewed cross-sectionally, is generally elliptical or oval. The body 22′ includes a front panel 24′ and a rear panel 26′. The front panel 24′ and the rear panel 26′ exhibit a generally inward, arcuate shape which could also be described as concave, defining a hourglass silhouette. The front panel 24′ and the rear panel 26′ are also arcuately shaped in a transverse direction. Transversely, the arcuate shape is generally outwardly shaped or convex.

Similar to the container 10, the front panel 24′ and the rear panel 26′ of the container 10′ are provided with ribbings 28′. Unlike the container 10, the ribbings 28′ of the container 10′ are oriented in both vertical and horizontal directions. As illustrated in FIGS. 6 and 7, front panel 24′ and rear panel 26′ each include horizontal sections 29 separated by horizontally oriented ribbings 28′. In each horizontal section 29 are located varying amounts of vertically oriented ribbings 28′. As can be appreciated, varying amounts of horizontally oriented and vertically oriented ribbings are contemplated.

Separating the front panel 24′ from the rear panel 26′ is a pair of column portions 30′. The column portions 30′ exhibit a shape which is generally inwardly shaped or concave, at least when the container 10′ is initially formed. The radial extent of this concave shape is less than that of the front panel 24′ and the rear panel 26′. The transition between the column portions 30′, and the front panel 24′ and the rear panel 26′ comprises a transition wall or step 32′ which exhibits a contour similar to that of the column portions 30′ themselves.

The front panel 24′, the rear panel 26′, the vertically and horizontally oriented ribbings 28′ and the column portions 30′ of the container 10′, when hot-filled, all function similar to the front panel 24, the rear panel 26, the ribbings 28 and the column portions 30 as disclosed above for the container 10.

The containers 10 and 10′ as thus described are as originally formed. For the sake of brevity, the discussion will now focus on the container 10, however, it is contemplated that the following would equally apply to the container 10′ as well. After being filled with a hot product, capped and cooled, the product within the container 10 decreases in volume. This reduction in volume produces a reduction in pressure. The front and rear panels 24 and 26 of the container 10 controllably accommodate this pressure reduction by being capable of pulling inward, under the influence of the reduced pressure, as shown in phantom lines 34 in FIG. 1 and as further shown in FIG. 3*b*. The overall large dimension of the two panel 24 and 26, approximately two-thirds (⅔) of the angular or circumferential extent of the container 10, facilitates the ability of the panels 24 and 26 to accommodate a significant amount of the reduced pressure or vacuum. The panels 24 and 26 are configured such that they absorb at least 50% of the reduced pressure or vacuum, and preferably at least 65%, and most preferably about 85% upon cooling.

As the panels 24 and 26 contract inward, the generally elliptical shape of the body 22 causes the more rigid column portions 30 to deflect more radially outward, providing the column portions 30 with a more upright orientation. This phenomenon is shown in phantom lines 36 in FIG. 2 and further shown in FIG. 3*b*. Additionally, when a force is applied to the top of an empty container 10, panels 24 and 26 are caused to contract inward. This in turn causes the generally elliptical shape of the body 22 to narrow and the column portions 30 to assume a more upright orientation enhancing resistance to the applied force.

In an alternative use, once opened, the containers 10 and 10′ are squeezable to dispense product therefrom. Initially, there is little resistance to squeezing against the panels 24 and 26, and 24′ and 26′. This is in part because of the panel's large size, and in part because of reduced weight and corresponding wall thickness reductions as discussed below. However, the resistance to further squeezing generally increases in a repeatable manner. This resistance is consistently applied because of the mirrored nature of the panels 24 and 26, and 24′ and 26′, and because the concave shaped panels 24 and 26, and 24′ and 26′ resist buckling. As a result, a consistent amount of product is repeatedly delivered from the containers 10 and 10′. By varying panel and column size, the specific amount generally dispensed for a container of a given capacity can be designed into the containers 10 and 10′.

Because of the significant reduction in vacuum pressure capabilities within the containers 10 and 10′ after cooling, the containers 10 and 10′ have a greater propensity to not retain dents which normally occur during handling or shipping. Containers with higher resultant vacuum pressures (and therefore less vacuum accommodation) tend to retain or hold such dents as a result of the vacuum forces themselves.

Figures 8, 9:
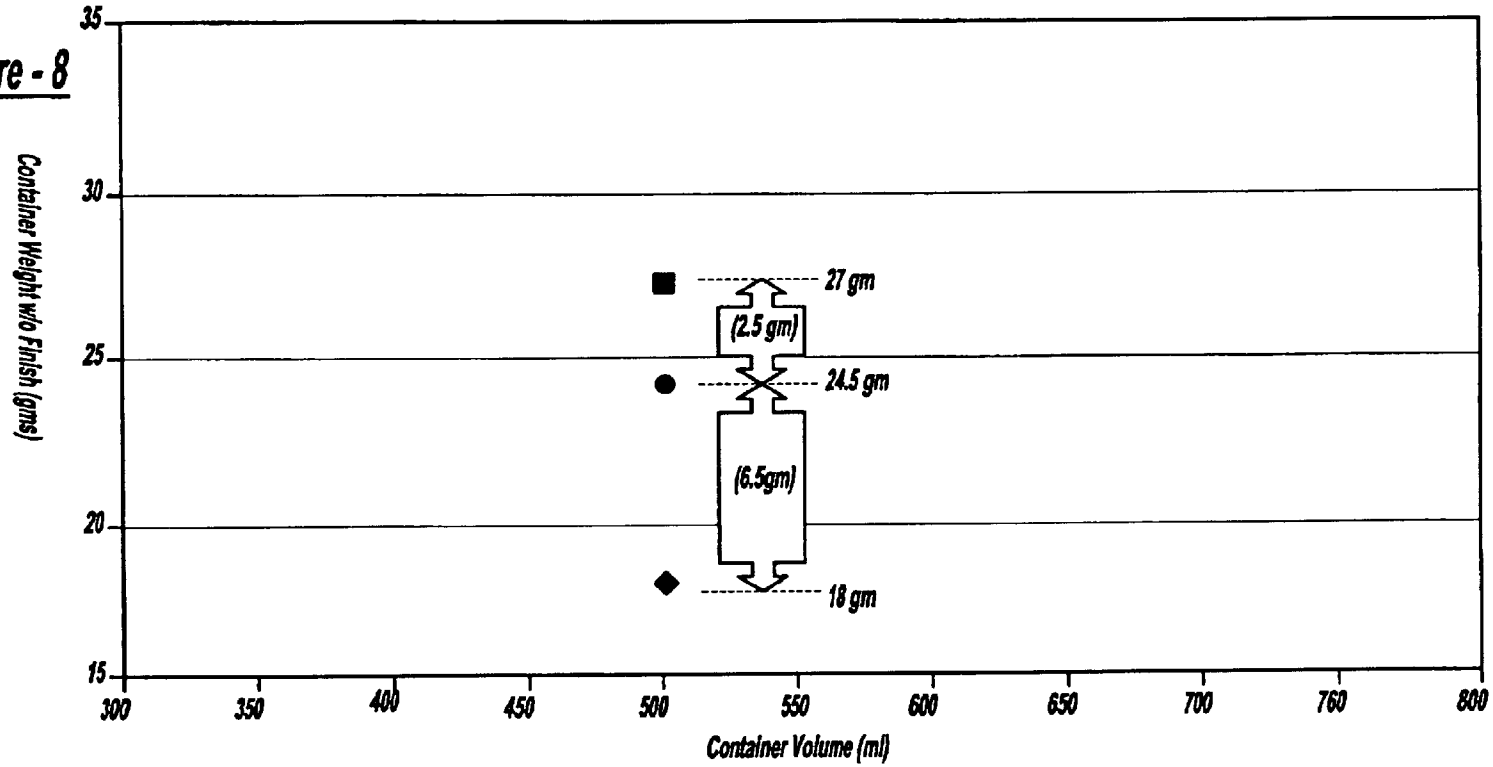
FIG. 8 is a chart comparing the weight of current stock containers with that of the container embodying the principles of the present invention.
FIG. 9 is a table comparing the weight of current stock containers with that of the container according to the present invention.

The novel shape of the containers 10 and 10′ further lends the containers 10 and 10′ to light weighting. As compared to containers of similar volumetric sizes and types, the containers 10 and 10′ generally realize at least a twenty-two percent (22%) reduction in weight. For example, a current round 500-ml container, approximately sixteen (16) fluid ounces, manufactured by a competitor, weighs 29.0 grams (including the finish) and 24.5 grams (without the finish) (designated as ● in FIGS. 8 and 9). A 500-ml container according to this invention weighs 22.5 grams (including the finish) and 18 grams (without the finish) (designated as ◆ in FIGS. 8 and 9), a reduction of 6.5 grams. Reductions of at least 5 grams are expected for other similar containers as well. For comparison, the Assignee of the present invention owns a current round 500-ml container, with vacuum panels, weighing 31.5 grams (including the finish) and 27 grams (without the finish) (designated as ■ in FIGS. 8 and 9). FIGS. 8 and 9 illustrate, in chart and table form, weight comparisons for current stock containers, and the containers 10 and 10′ in an approximately sixteen (16) fluid ounce variety. It should be noted that the weights in the chart of FIG. 8 were calculated without the neck or finish weight while the weights in the table of FIG. 9 were calculated with the neck or finish weight. Thus, as illustrated in FIGS. 8 and 9, the containers 10 and 10′ exhibit a significant amount of weight reduction which lends the containers 10 and 10′ to light weighting.

While the above description constitutes the preferred embodiment of the present invention, it will be appreciated that the invention is susceptible to modification, variation and change without departing from the proper scope and fair meaning of the accompanying claims.

What is claimed is:

1. A lightweight container structure comprising:

a container made of a generally biaxially oriented polyester material; said container having a neck portion defining a mouth; a shoulder portion formed with said neck portion and extending downward therefrom; a bottom portion forming a base; and a sidewall extending between and joining said shoulder portion with said bottom portion, said sidewall having a substantially oval shape in cross-section, said oval shape including a pair of opposing ends and a pair of opposing sides, said sidewall including a pair of opposing columns and a pair of opposing panels, said panels being located at said opposing sides of said oval shape and between said columns, said panels vary in width progressing from a top to a bottom thereof, said columns vary in width progressing from a top to a bottom thereof, and a plurality of transition walls each disposed between and joining one of said pair of opposing columns and an adjacent one of said pair of opposing panels, wherein said columns are generally concave shaped;

a fluid within said container wherein said fluid when filled in said container is initially at a temperature measurably above room temperature;

a closure engaging said neck portion and sealing said fluid within said container while said fluid remains at said temperature; and said neck portion, said shoulder portion, said sidewall, said bottom portion and said fluid sealed within said container by said closure all cooperate to allow said columns of said sidewall to deflect radially outward to a generally vertical orientation as said panels of said sidewall contract inward from vacuum forces created within said container as said fluid cools from said temperature measurably above room temperature after said sealing of said container.

2. The lightweight container structure according to claim 1 wherein said panels are mirror images of one another.

3. The lightweight container structure according to claim 1 wherein said columns are mirror images of one another.

4. The lightweight container structure according to claim 1 wherein a combined circumferential length of said panels is greater than two-thirds (⅔) of a total sidewall circumference defined at a midpoint of said sidewall.

5. The lightweight container structure according to claim 1 wherein said columns include an upper end, a lower end and a center, and decrease in width over at least a portion of their length progressing from said upper end and said lower end toward said center.

6. The lightweight container structure according to claim 1 wherein said columns include a longitudinal midpoint and have a minimum width about said longitudinal midpoint.

7. The lightweight container structure according to claim 1 wherein said sidewall has an inwardly concave silhouette elevationally viewed from a side facing one of said columns.

8. The lightweight container structure according to claim 1 wherein said sidewall has a first hourglass silhouette when viewed from a side facing one of said columns and has a second hourglass silhouette when viewed from a side facing one of said panels, said second hourglass silhouette being less defined than said first hourglass silhouette.

9. The lightweight container structure according to claim 1 wherein a material forming said sidewall is heat treated.

10. The lightweight container structure according to claim 1 wherein said panels are vacuum panels.

11. The lightweight container structure according to claim 10 wherein said panels absorb greater than 50% of a vacuum applied to said container upon cooling after hot-filling.

12. The lightweight container structure according to claim 10 wherein said panels absorb greater than 65% of a vacuum applied to said container upon cooling after hot-filling.

13. The lightweight container structure according to claim 10 wherein said panels absorb greater than 85% of a vacuum applied to said container upon cooling after hot-filling.

14. The lightweight container structure according to claim 10 wherein a 500 ml version container weighs less than 23 grams inclusive of said neck portion.

15. The lightweight container structure according to claim 10 wherein a 500 ml version container weighs less than 18.5 grams exclusive of said neck portion.

16. The lightweight container structure according to claim 1 wherein said panels progressively exhibit an increase in deflection resistance as said panels are deflected inward.

17. The lightweight container structure according to claim 16 wherein a substantially consistent dosage of a product contained within said container is dispensed upon successive manual inward deflection of said panels.

18. The lightweight container structure according to claim 10 wherein said panels progressively exhibit an increase in deflection resistance as said panels are deflected inward.

19. The lightweight container structure according to claim 18 wherein a substantially consistent dosage of a product contained within said container is dispensed upon successive manual inward deflection of said panels.

20. The lightweight container structure according to claim 1 wherein said shoulder portion defines a generally circular cross section immediately adjacent to said sidewall and said bottom portion defines a generally circular cross section immediately adjacent to said sidewall.

21. The lightweight container structure according to claim 20 wherein said shoulder portion defines a maximum diameter of said container.

22. The lightweight container structure according to claim 20 wherein said bottom portion defines a maximum diameter of said container.

23. The lightweight container structure according to claim 22 wherein said shoulder portion defines a second diameter, said second diameter being substantially equal to said maximum diameter.

24. The lightweight container structure according to claim 1 wherein said shoulder portion, said bottom portion and said sidewall include an embossed motif.

25. The lightweight container structure according to claim 7 wherein said panels include a grip allowing a person to grasp said container with a thumb and fingers of one hand.

26. The lightweight container structure according to claim 25 wherein said panels initially offer resistance to squeezing pressure of said thumb and fingers of one hand against said panels and progressively increases resistance with an increase of squeezing pressure.

27. A lightweight container structure comprising:

a container made of a generally biaxially oriented polyester material; said container having a neck portion defining a mouth; a shoulder portion formed with said neck portion and extending downward therefrom; a bottom portion forming a base; and a sidewall extending between and joining said shoulder portion with said bottom portion, said sidewall including a pair of opposing columns and a pair of opposing panels, said columns having a shape that is generally concave when the container is initially formed and viewed from a side facing one of said panels;

a fluid within said container;

a closure engaging said neck portion and sealing said fluid within said container; and said neck portion, said shoulder portion, said sidewall, said bottom portion and said fluid sealed within said container by said closure all cooperate to allow said panels to deflect inwardly and said columns to deflect outwardly in response to reduced pressure in said container, and wherein said columns deflect outwardly from said generally concave orientation to a generally vertical orientation in response to reduced pressure.

28. A lightweight container structure comprising:

a container made of a generally biaxially oriented polyester material; said container having a neck portion defining a mouth; a shoulder portion formed with said neck portion and extending downward therefrom; a bottom portion forming a base; and a sidewall extending between and joining said shoulder portion with said bottom portion, said sidewall having a substantially oval shape in cross-section, said oval shape including a pair of opposing ends and a pair of opposing sides, said sidewall including a pair of opposing columns and a pair of opposing panels, said panels being located at said opposing sides of said oval shape and between said columns, said panels vary in width progressing from a top to a bottom thereof, said columns vary in width progressing from a top to a bottom thereof, and a plurality of transition walls each disposed between and joining one of said pair of opposing columns and an adjacent one of said pair of opposing panels, wherein said columns are generally concave shaped when the container is initially formed and wherein said columns deflect outwardly from said generally concave orientation to a generally vertical orientation in response to reduced pressure.

* * * * *

UNITED STATES PATENT AND TRADEMARK OFFICE

CERTIFICATE OF CORRECTION

PATENT NO. : 6,837,390 B2
DATED : January 4, 2005
INVENTOR(S) : Michael T. Lane and Mark A. Chapman It is certified that error appears in the above-identified patent and that said Letters Patent is hereby corrected as shown below:

Column 3,
Lines 42-43 “e tire” should be -- entire --.

Signed and Sealed this

Sixteenth Day of May, 2006

JON W. DUDAS
*Director of the United States Patent and Trademark Office*